US009479864B2

(12) United States Patent
Shirai

(10) Patent No.: US 9,479,864 B2
(45) Date of Patent: Oct. 25, 2016

(54) EFFECT APPLYING APPARATUS AND EFFECT APPLYING METHOD

(71) Applicant: Yamaha Corporation, Hamamatsu-shi, Shizuoka-ken (JP)

(72) Inventor: Mizuyuki Shirai, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 20 days.

(21) Appl. No.: 14/141,276

(22) Filed: Dec. 26, 2013

(65) Prior Publication Data

US 2014/0193004 A1 Jul. 10, 2014

(30) Foreign Application Priority Data

Jan. 4, 2013 (JP) ..... 2013-000026

(51) Int. Cl.

| | |
|---|---|
| ***H02B 1/00*** | (2006.01) |
| ***H04R 3/00*** | (2006.01) |
| ***H04H 60/04*** | (2008.01) |
| ***G10H 1/00*** | (2006.01) |
| ***G10H 1/46*** | (2006.01) |

(52) U.S. Cl.

CPC ..... *H04R 3/00* (2013.01); *G10H 1/0091* (2013.01); *G10H 1/46* (2013.01); *H04H 60/04* (2013.01); *G10H 2210/281* (2013.01); *G10H 2250/041* (2013.01)

(58) Field of Classification Search

None

See application file for complete search history.

(56) References Cited

U.S. PATENT DOCUMENTS 5,463,691 A 10/1995 Nakae et al.

FOREIGN PATENT DOCUMENTS

JP 06-083343 A 3/1994
JP 3192767 B2 7/2001

OTHER PUBLICATIONS

Yamaha. (2011). "Mixing Console MGP16X, MGP12X, Owner's Manual," Hamamatsu, Japan, http://www.yamaha.co.jp/manual/, with English translation, 72 pages.

Yamaha. (Date Unknown). "Bass Simul-Effect Processor FX500B, Operation Manual," Hamamatsu, Japan, with English translation, 152 pages.

European Search Report dated Jul. 24, 2014, for EP Application No. 13197907.2, eight pages.

Yamaha. (Jan. 1, 1989). "Simul-Effect Processor FX500 Operation Manual," Operation Manual, 97 pages.

Notification of the Second Office Action dated Jan. 6, 2016, for CN Application No. 201410005206.3, with English translation, 16 pages.

*Primary Examiner* — Regina N. Holder

(74) *Attorney, Agent, or Firm* — Morrison & Foerster LLP

(57) ABSTRACT

When a knob is at a center position, transmission levels of first volumes on a path from a second effector to a first effector, and second volumes on a path from the first effector to the second effector are both zero, and the first effector and the second effector operate independently. When the knob is displaced to right side from the center position, the transmission level of the second volumes is controlled according to the displacement amount, but the transmission level of the first volumes stays at zero. Thus, the second effector is connected in series to the first effector. When the knob is displaced to left side from the center position, the transmission level of the first volumes is controlled according to the displacement amount, but the transmission level of the second volumes stays at zero. Thus, the first effector is connected in series to the second effector.

13 Claims, 4 Drawing Sheets

EFFECT APPLYING APPARATUS AND EFFECT APPLYING METHOD

TECHNICAL FIELD

The invention relates to an effect applying apparatus and an effect applying method which enable switching of connection between a first effector applying a first audio effect and a second effector applying a second audio effect and level adjustment of an audio signal supplied from one effector to another effector when the switching is performed to connect the effectors.

BACKGROUND ART

In a conventional mixer described in NPL 1 which mixes sounds and the like collected with multiple microphones and sends the mixed sounds to a power amplifier and various recording apparatuses, two systems of effectors are provided, and each effector applies an effect such as reverb or delay to each audio signal inputted to the system in which it is provided. In this case, when the effector of one system is a delay and an effector of the other system is a reverb, there may be cases where it is desired to apply the reverb after the delay is applied. However, in this conventional mixer, although the two systems of effectors are provided, there is no connection between the systems, and thus an output of one effector cannot be supplied to the other effector. Specifically, it is possible to apply the delay in one system and apply the reverb in the other system simultaneously, but it is not possible to apply the reverb by the effector of the other system to an audio signal to which the delay is applied by the effector of the one system.

Further, in a conventional effector described in NPL2, effectors of a modulation stage and a reverb stage are provided in series, and a reverb can be applied in the reverb stage to an audio signal to which an audio effect is applied in the modulation stage. The order of the effector in the modulation stage and the effector in the reverb stage is replaced in a toggle manner in the series of effectors which are applied sequentially, according to operation on a switch by the user. However, this conventional effector only has one system, and thus the effectors in the modulation stage and the reverb stage are not assumed to be used in different systems from each other.

Moreover, in the conventional effect applying apparatus described in PTL1, effect units are provided respectively in plural systems, and a wiring status between the systems of the effect units can be set. In this case, modes of wiring statuses are set in advance, and a wiring status of a predetermined mode can be set by the user by selecting a wiring selection number. In this conventional effect applying apparatus, an effect can be applied to each of audio signals of the plural systems, and by selecting a wiring status in which an audio signal to which an effect is applied in one system is inputted to another system, a further effect can be applied in the another system to the audio signal to which the effect is applied in the one system. Further, in this conventional effect applying apparatus, the user can set or edit parameters of effects in the effect units in the respective systems by operating controls provided on an operating panel.

CITATION LIST

Non Patent Literature

{NPL1} Yamaha Corporation, MIXING CONSOLE MGP16X MGP12X Owner's Manual (in Japanese), pp. 22-23, [online], [searched on Aug. 24, 2011], the Internet <http://www2.yamaha.co.jp/manual/pdf/pa/japan/mixers/mgp16x_ja_om_b0.pdf>

{NPL2} Yamaha Corporation, BASS SIMUL-EFFECT PROCESSOR FX500B Operation Manual (in Japanese), p. 17, [online], [searched on Aug. 24, 2011], the Internet <http://www2.yamaha.co.jp/manual/pdf/pa/japan/signal/FX500BJ.pdf>

Patent Literature

{PTL1} JP 3192767 B2

SUMMARY OF INVENTION

Technical Problem

In the conventional effect applying apparatus, a wiring status for inputting an audio signal to which an audio effect is applied by an effector of one system to an effector of another system so as to apply a further audio effect thereto is made by selecting a wiring status with a selecting control provided on an operating panel. Then, level adjustment of the audio signal supplied from the effector of the one system to the effector of the another system is performed with a controlling control for parameter setting provided on a panel control. Thus, there is a problem that the two controls, the selecting control and the controlling control, are necessary on the operating panel in the conventional effect applying apparatus.

Accordingly, it is an object of the invention to provide an effect applying apparatus and an effect applying method which enable intuitive use of switching of connection between effectors and level adjustment of an audio signal supplied from one effector to another effector without increasing a disposition space of controls.

Solution to Problem

To achieve the above object, the invention provides an effect applying apparatus including: a first effector for applying a first audio effect to an audio signal supplied to the first effector; a second effector for applying a second audio effect to an audio signal supplied to the second effector; a control which can be displaced by an operation by a user; and a controller for switching connection between the first effector and the second effector, and controlling level of an audio signal supplied from one of the effectors disposed in a previous stage to another of the effectors disposed in a subsequent stage, according to amount of displacement of the control from a predetermined position.

The above and other objects, features and advantages of the invention will be apparent from the following detailed description which is to be read in conjunction with the accompanying drawings.

Advantageous Effects of Invention

According to the invention, according to amount of displacement from an operating reference position of a control unit, an audio signal to which a first or second audio effect is applied by an effector disposed in a previous stage is supplied to an effector disposed in a subsequent stage, and a second or first audio effect is further applied to the audio signal. Further, level of the audio signal from the effector disposed in the previous stage is adjusted according to the amount of displacement from the operating reference position of the control unit, and the adjusted audio signal is supplied to the effector provided in the subsequent stage. Thus, two operations can be performed with one operating unit, which are switching of connection between a first effector and a second effector and level adjustment of an audio signal supplied from the effector disposed in the previous stage to the effector disposed in the subsequent stage. Thus, increase in disposition space of the control unit can also be prevented as much as possible.

BRIEF DESCRIPTION OF DRAWINGS

FIG. 7 is a circuit block diagram illustrating another structure of the sys effect processing module.

DESCRIPTION OF EMBODIMENTS

Figure 1:
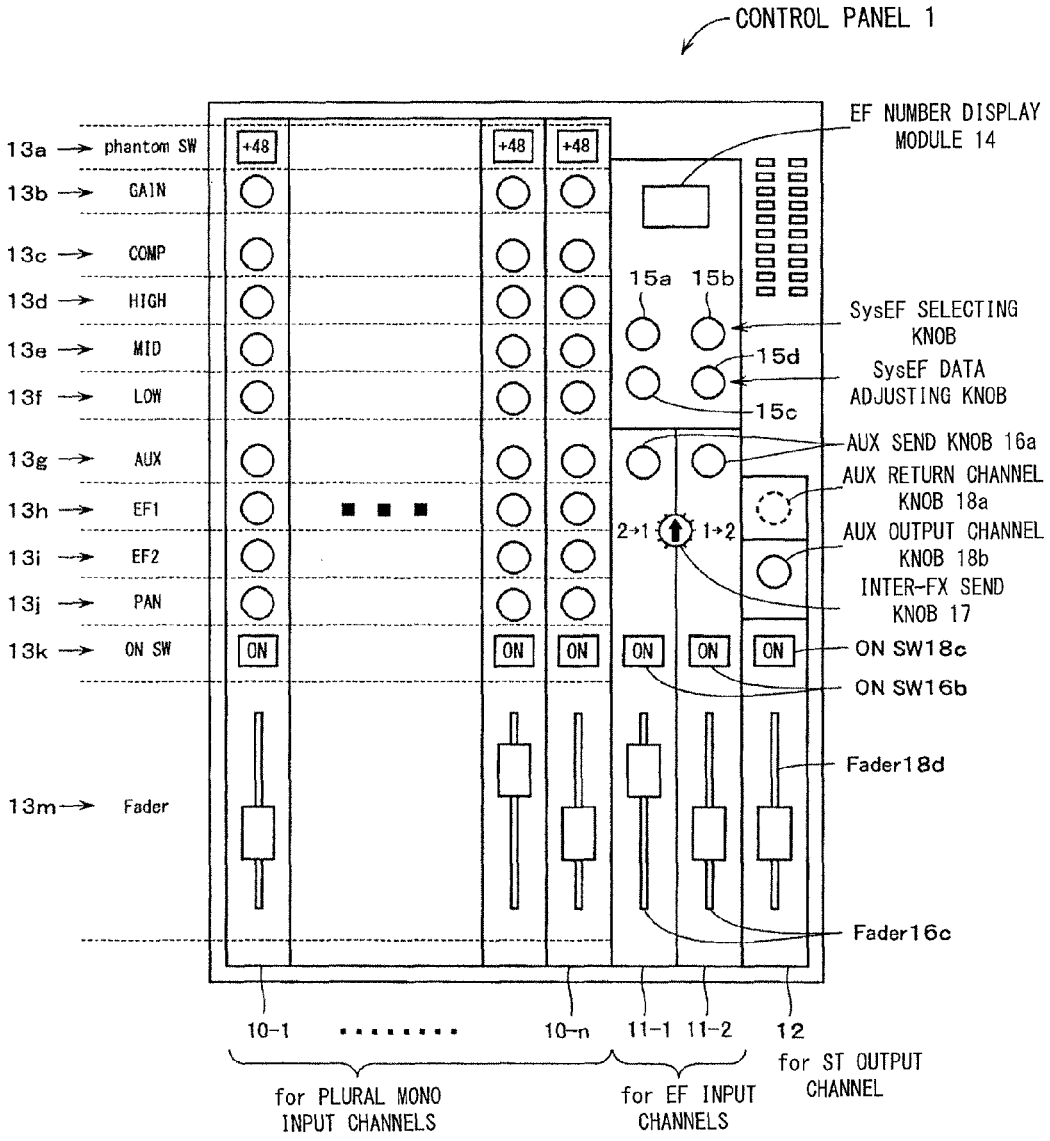
FIG. 1 is a diagram illustrating a structure of an operating panel on a mixer including an embodiment of an effect applying apparatus of the invention.

FIG. 1 illustrates a structure of an operating panel on a mixer including an embodiment of an effect applying apparatus of the invention.

The operating panel 1 of the mixer illustrated in FIG. 1 includes a monaural input section, an internal effect section, an effect input section, and so on. To the monaural input section, n pieces of channel strips 10-1, . . . , **10-*n*** for plural monaural input channels (mono input channels) belong. In the illustrated example, the number of mono input channels is eight (n=8).

To the internal effect section, an EF number display module 14, SysEF selecting knobs **15*a*, 15*b*, and SysEF data adjusting knobs 15*c*, 15*d* belong. To the effect input section, two channel strips 11-1, 11-2 for two effect input channels (first and second EF input channels) belong. Status and parameter of the first EF input channel can be set by the channel strip 11-1, status and parameter of the second EF input channel can be set by the channel strip 11-2. An AUX send knob (AUX) 16*a*, an ON switch (ON SW) 16*b*, and an effect fader (Fader) 16*c* are provided in each of the channel strips 11-1, 11-2. Further, to the effect input section, an AUX return channel knob 18*a* belongs, and an inter-FX send knob 17 belongs, which is provided across the boundary between the channel strip 11-1 and the channel strip 11-2. Moreover, in the operating panel 1, an AUX output channel knob 18*b* and one channel strip 12** for one stereo output channel (ST output channel) are provided.

Statuses and parameters of respective input channels of the first mono input channel to n-th mono input channel can be set by the channel strips 10-1 to **10-*n* of the monaural input section, and controls including a phantom switch (phantom SW) 13*a* and a gain adjusting knob (GAIN) 13*b*, a compressor adjusting knob (COMP) 13*c*, a high-band adjusting knob (HIGH) 13*d*, a mid-band adjusting knob (MID) 13*e*, a low-band adjusting knob (LOW) 13*f*, an AUX send knob (AUX) 13*g*, a first FX send knob (EF1) 13*h*, a second FX send knob (EF2) 13*i*, a localization position adjusting knob (PAN) 13*j*, a channel switch (ON SW) 13*k*, and a channel fader (Fader) 13*m* are provided in each of the channel strips 10-1 to 10-*n***.

Among these controls, the phantom SW **13*a*** is a phantom switch for performing control to provide a phantom power supply to a condenser microphone when a microphone for gathering sound, which inputs sound to each of input channels of the first to n-th mono input channels, is a condenser microphone.

Among the controls belonging to the internal effect section, the SysEF selecting knob **15*a* is a knob for selecting a type of effect, such as various reverbs and various delays, of a first effector from among eight types for example, and the SysEF selecting knob 15*b* is a knob for selecting a type of effect, such as various reverbs and various delays, of a second effector from among sixteen types for example. The numbers of the effect types selected by the SysEF selecting knobs 15*a*, 15*b* are displayed on the EF number display module 14. Further, the SysEF data adjusting knobs 15*c*, 15*d* are controls for adjusting parameters of the effects selected by the SysEF selecting knobs 15*a*, 15*b***.

The AUX return channel knob **18*a* which belongs to the effect input section is a control for adjusting level of an audio signal to which an effect is applied, which is to be sent to an ST (stereo) bus from an external effector when the external effector is used for application of effect, and an audio signal outputted from an FX bus is sent to the external effector. When the external effector is not used, it is possible to omit this AUX return channel knob 18*a*. Further, the AUX output channel knob 18*b* provided on the operating panel 1** is a control for adjusting level of an audio signal outputted from an AUX output terminal, which is an output terminal of an AUX bus. Note that the audio signal from the AUX output terminal is sent to the above-described external effector, a monitor speaker for performer, or the like.

Figure 2:
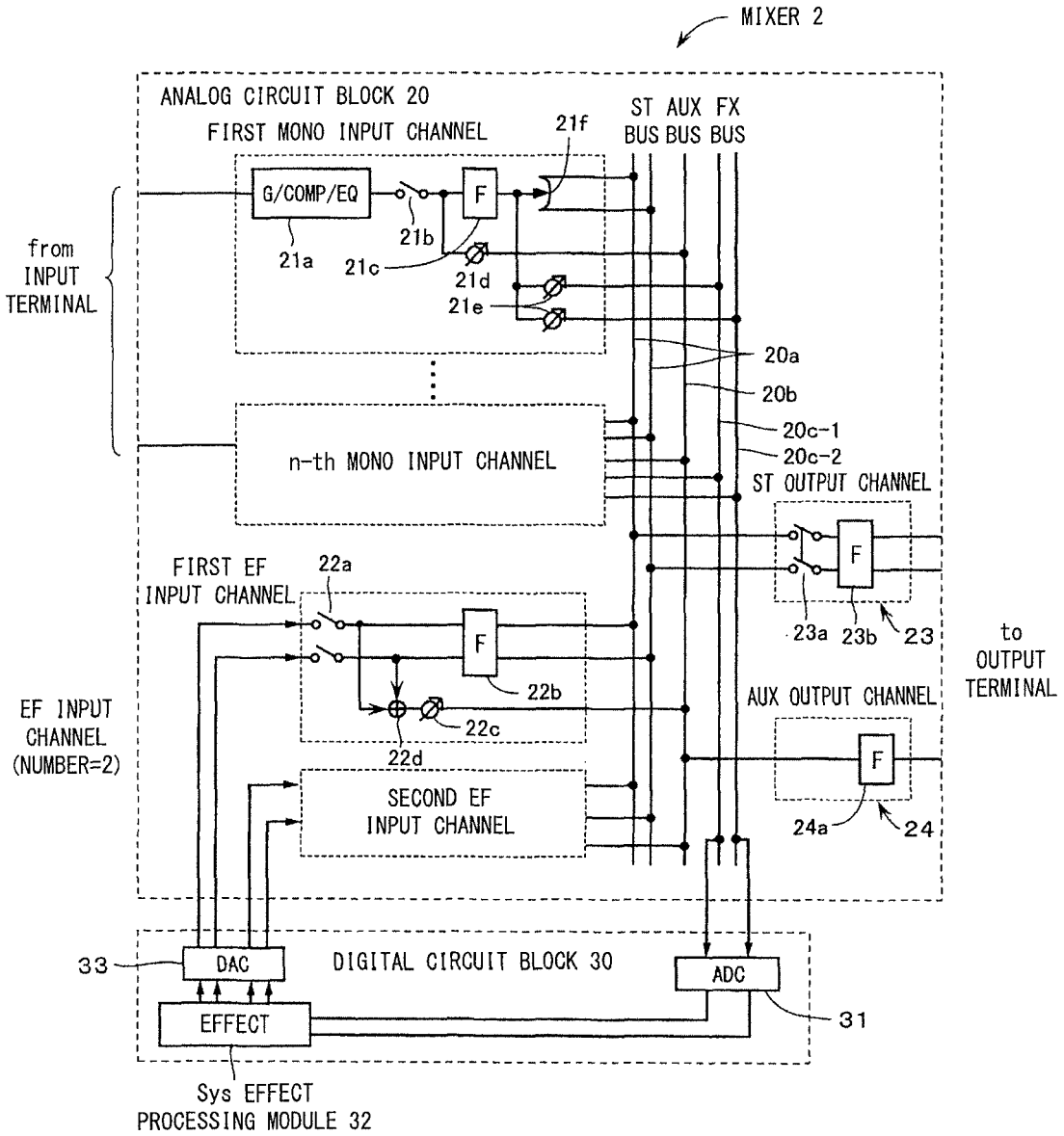
FIG. 2 is a circuit block diagram illustrating an overall image of mixing processing in the mixer illustrated in FIG. 1.

Next, FIG. 2 illustrates a circuit block diagram illustrating an overall image of mixing processing in a mixer 2 having the operating panel 1 illustrated in FIG. 1.

In FIG. 2, the mixer 2 includes an analog circuit block 20 and a digital circuit block 30. The analog circuit block 20 is provided with circuits of the first to n-th mono input channels, and the first and second EF input channels. Further, in the digital circuit block 30, a Sys effect processing module 32 having the first effector and the second effector is provided. Moreover, the analog circuit block 20 is provided with an ST bus **20*a* constituted of L, R for stereo, one AUX bus 20*b*, and two FX buses 20*c*-1, 20*c*-2 for effect, and the transmission levels of audio signals supplied from the first to n-th mono input channels to the respective buses are controlled individually regarding the respective buses. Audio signals mixed by the ST bus 20*a* are outputted from a stereo output terminal via an ST output channel 23, and audio signals mixed by the AUX bus 20*b* is outputted from the AUX output terminal via an AUX output channel 24**.

Note that when applying an effect, audio signals of any pieces of the first to n-th mono input channels to which it is desired to apply an effect are inputted to either or both of the FX buses **20*c*-1, 20*c*-2. The inputted audio signals are mixed by the FX bus 20*c*-1 and/or the FX bus 20*c*-2, sent to each of the first effector and the second effector of the Sys effect processing module 32 in the digital circuit block 30**, and an effect is applied to the mixed audio signal by each of the effectors. Details of this will be described later.

Structures of the first to n-th mono input channels are all the same, and statuses and parameters of each of the first to n-th mono input channels can be individually set by the switches 13*a*, 13*k*, the knobs 13*b* to 13*i*, and the fader knob 13*m* of the channel strips 10-1 to 10-*n* in the operating panel 1 illustrated in FIG. 1. For example, structure of the first mono input channel will be described with reference to the operating panel 1 illustrated in FIG. 1. In a characteristic adjusting module (G/COMP/EQ) 21*a* of the first mono input channel, gain (G) of an audio signal from the input terminal is adjusted. The audio signal is then compressed in a compressor (COMP), and further adjusted in frequency characteristic in an equalizer (EQ). In this case, by operating GAIN 13*b* of the channel strip 10-1, gain of a head amplifier of the first mono input channel is adjusted to allow sensitivity adjustment, and by operating COMP 13*c*, degree of application of the compressor of the first mono input channel can be adjusted. Turning the COMP 13*c* right allows automatic adjustment of not only the compression effect but also the output level. Further, by operating the HIGH 13*d*, the MID 13*e*, the LOW 13*f*, frequency characteristics of high band, middle band, and low band of a three-band equalizer of the first mono input channel can be adjusted.

By operating the ON SW 13*k* of the channel strip 10-1, ON/OFF of channel switch 21*b* can be switched. Operating the ON SW 13*k* so as to turn on the channel switch 21*b* allows sending audio signals of the first mono input channel to the ST bus 20*a*, the AUX bus 20*b*, and the FX buses 20*c*-1, 20*c*-2, and operating the ON SW 13*k* so as to turn off the channel switch 21*b* prevents sending of audio signals of the first mono input channel to the buses. Describing the case where the channel switch 21*b* is turned on, an audio signal outputted from the characteristic adjusting module (G/COMP/EQ) 21*a* is sent in parallel to a fader (F) 21*c* and a volume 21*d* via a channel switch 21*b*, and a lamp incorporated in the ON SW 13*k* turns on, displaying that the channel switch 21*b* is turned on. Here, the volume 21*d* is adjusted by operating the AUX 13*g* of the channel strip 10-1, enabling to adjust level of the audio signal sent from the first mono input channel to the AUX bus 20*b*. Further, by operating the Fader 13*m* of the channel strip 10-1, the fader (F) 21*c* is adjusted to enable adjustment of output level of the audio signal of the first mono input channel, thereby enabling adjustment of balance of sound volume between channels. An output from the fader (F) 21*c* is sent to a pan 21*f* and two volumes 21*e*. By operating the PAN 13*j* of the channel strip 10-1, the pan 21*f* is adjusted, enabling to adjust position of sound image of an audio signal from the first mono input channel in a stereo audio signal of the ST bus 20*a*. Moreover, by operating the EF1 13*h* and the EF2 13*i* of the channel strip 10-1, two volumes 21*e* can be adjusted respectively so as to adjust levels of audio signals, which are adjusted in level by the fader (F) 21*c*, of the first mono input channel being sent to the two FX buses 20*c*-1, 20*c*-2.

Next, statuses and parameters of the first and second EF input channels can be set by the switches and knobs 14 to 17 of the channel strips 11-1, 11-2 on the operating panel 1 illustrated in FIG. 1. The first and second EF input channels have the same structure, and for example, the structure of the first EF input channel will be described with reference to the operating panel 1 illustrated in FIG. 1. An FX1 output signal is inputted via a channel switch 22*a* to the first EF input channel. The FX1 output signal is a stereo audio signal outputted from the first effector and converted into an analog signal in the digital circuit block 30. By operating the ON SW 16*b* of the channel strip 11-1, ON/OFF of the channel switch 22*a* can be switched. Operating the ON SW 16*b* so as to turn on the channel switch 22*a* allows sending of the FX1 output signal from the first EF input channel to the ST bus 20*a* and the AUX bus 20*b*, and operating the ON SW 16*b* so as to turn off the channel switch 22*a* prevents sending of the FX1 output signal from the first EF input channel to the ST bus 20*a* and the AUX bus 20*b*. Explaining the case where the channel switch 22*a* is turned on, the FX1 output signal is supplied to a fader (F) 22*b* and an adder 22*d* via the channel switch 22*a*. The FX1 output signal adjusted in level by the fader (F) 22*b* is sent to the ST bus 20*a*. Further, components L, R of the FX1 output signal are added in the adder 22*d* resulting in a monaural audio signal, which is sent to the AUX bus 20*b* via a volume 22*c*. By operating the Fader 16*c* of the channel strip 11-1, the fader (F) 22*b* can be adjusted, enabling to adjust level of the FX1 output signal sent from the first EF input channel to the ST bus 20*a*. Further, by operating the AUX 16*a* of the channel strip 11-1, the volume 22*c* can be adjusted, enabling to adjust the level of the FX1 output signal, which is converted into monaural, sent from the first EF input channel to the AUX bus 20*b*.

Note that to the second EF input channel, an FX2 output signal, which is a stereo audio signal outputted from the second effector and is converted into an analog signal in the digital circuit block 30, is inputted, and by operating the ON SW 16*b*, the Fader 16*c*, and the AUX 16*a* of the channel strip 11-2, ON/OFF of the channel switch in the EF input channel 2 can be switched, and each sending level of the FX2 output signal to the ST bus 20*a* and the AUX bus 20*b* can be adjusted.

Audio signals mixed in the two FX buses 20*c*-1, 20*c*-2 are sent to the digital circuit block 30. Audio signals of two systems, an FX1 input signal from the FX bus 20*c*-1 and an FX2 input signal from the FX bus 20*c*-2, which are inputted to the digital circuit block 30, are inputted to the ADC 31 and are converted into a digital FX1 input signal and a digital FX2 input signal in the ADC 31. The digital FX1 input signal is inputted to the first effector of the Sys effect processing module 32, and the digital FX2 input signal is inputted to the second effector of the Sys effect processing module 32. In each of the first effector and the second effector, the effect type selected regarding the effector is applied. Note that the first effector and the second effector of the Sys effect processing unit 32 are structured to apply an effect to a stereo audio signal, and hence the effect is applied to a stereo audio signal resulted from dividing a monaural audio signal into L and R. The digital stereo audio signals to which the effects of two systems are applied, that is, the FX1 output signal outputted from the first effector of the Sys effect processing module 32 and the FX2 output signal outputted from the second effector thereof, are converted into analog stereo output signals of FX1 output signal and FX2 output signal in the DAC 33, which are inputted to the first and second EF input channel, respectively.

Figure 3:
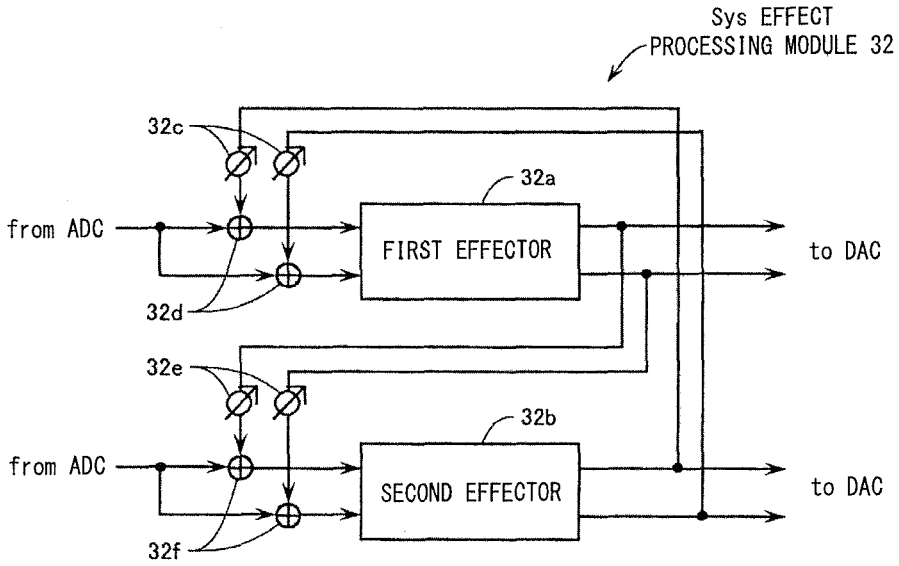
FIG. 3 is a circuit block diagram illustrating a structure of a sys effect processing module of the mixer illustrated in FIG. 1 and FIG. 2.

Here, FIG. 3 illustrates a circuit block illustrating a detailed structure of the Sys effect processing module 32.

Figure 4:
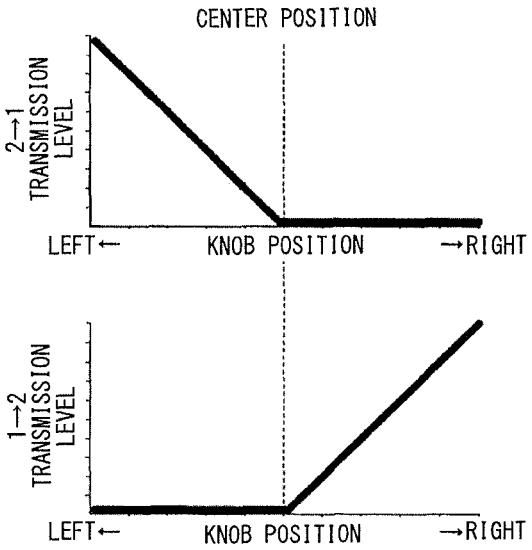
FIG. 4 is a diagram illustrating an example of transmission levels according to a knob position in the mixer illustrated in FIG. 1 and FIG. 2.

As illustrated in FIG. 3, the Sys effect processing module 32 is provided with a first effector 32*a* and a second effector 32*b*. The digital FX1 input signal inputted from the ADC 31 to the first effector 32*a* is divided in two to be a stereo audio signal, and inputted to the first effector 32*a* via adders 32*d*. Further, the digital FX2 input signal inputted from the ADC 31 to the second effector 32*b* is also divided in two to be a stereo audio signal, which is inputted to the second effector 32*b* via adders 32*f*. The FX1 output signal, which is a stereo audio signal to which an effect is applied by the first effector 32*a*, is sent to the DAC 33 and is also sent to the two adders 32*f* via two volumes 32*e*. The adders 32*f* add the FX2 input signal and the FX1 output signal which is adjusted in level by the volumes 32*e*. Further, the FX2 output signal, which is a stereo audio signal to which an effect is applied by the second effector 32*b*, is sent to the DAC 33 and is also sent to the two adders 32*d* via two volumes 32*c*. The adders 32*d* add the FX1 input signal and the FX2 output signal which is adjusted in level by the volumes 32*c*. The two volumes 32*c* and the two volumes 32*e* can be adjusted by rotating the inter-FX send knob 17 provided across the boundary between the channel strip 11-1 and the channel strip 11-2. In this case, an analog position signal, which indicates current position of the inter-FX send knob 17, is supplied from the inter-FX send knob 17 to the digital circuit block 30. The digital circuit block 30 converts the position signal into digital position data by a not-illustrated ADC and controls the transmission level between the two effectors according to the digital position data as illustrated in FIG. 4. Further, the first effector 32*a* and the second effector 32*b* are cross-connected with each other, and mode of this cross-connection can be switched by the inter-FX send knob 17.

FIG. 4 illustrates a diagram illustrating transmission levels (dB) which are amplification factors (attenuation factors) for audio signals adjusted by the two volumes 32*c* and the two volumes 32*e* relative to a rotation operating amount of the inter-FX send knob 17. In FIG. 4, the graph with a vertical axis being "1=>2 transmission level" illustrates the transmission level (dB) of the two volumes 32*e* relative to a knob position of the inter-FX send knob 17, and the graph with a vertical axis being "2=>1 transmission level" illustrates the transmission level (dB) of the two volumes 32*c* relative to the knob position of the inter-FX send knob 17. Note that "=>" means an arrow.

When the knob position of the inter-FX send knob 17 is at a center position, which is a predetermined position corresponding to a center position, the transmission levels of the two volumes 32*c* and the two volumes 32*e* are zero (level of $-\infty$ (negative infinity)) as illustrated in FIG. 4. Thus, the FX1 output signal to which an effect is applied by the first effector 32*a* is not inputted to the second effector 32*b*, and the FX2 output signal to which an effect is applied by the second effector 32*b* is not inputted to the first effector 32*a*. In this manner, when the inter-FX send knob 17 is at the center position, the first effector 32*a* and the second effector 32*b* are in a non-connected state, and operate independently in parallel with each other.

Further, when the inter-FX send knob 17 is rotated from the center position to the right side, transmission level of the two volumes 32*e* becomes a transmission level corresponding to the rotation operating amount as illustrated in FIG. 4, but transmission level of the two volumes 32*c* stays at zero. In this manner, when the knob position of the inter-FX send knob 17 is located on the right side of the center position, the FX1 output signal, to which an effect is applied, outputted from the first effector 32*a* is supplied to the adder 32*f* at a transmission level corresponding to the amount of the rotating operation, but the FX2 output signal, to which an effect is applied, outputted from the second effector 32*b* is not supplied to the adder 32*d*. Thus, only the FX1 input signal is inputted to the first effector 32*a*, and an audio signal of sum of the FX2 input signal and the FX1 output signal controlled in level, which are added by the adders 32*f*, is inputted to the second effector 32*b*, thereby applying the effect to the inputted audio signal. That is, the second effector 32*b* is connected in series after the first effector 32*a*, and this is described on the operating panel 1 as "1=>2". Then, the transmission level of the FX1 output signal to be sent from the first effector 32*a* to the second effector 32*b* at that time can be adjusted by a rotation operating amount toward the right side of the inter-FX send knob 17.

Moreover, when the inter-FX send knob 17 is rotated from the center position to the left side, transmission level of the two volumes 32*c* becomes a transmission level corresponding to the rotation operating amount as illustrated in FIG. 4, but transmission level of the two volumes 32*e* stays at zero. In this manner, when the inter-FX send knob 17 is located on the left side of the center position, the FX2 output signal, to which an effect is applied, outputted from the second effector 32*b* is supplied to the adder 32*d* at the transmission level corresponding to the amount of rotating operation, but the FX1 output signal, to which an effect is applied, outputted from the first effector 32*a* is not supplied to the adder 32*f*. Thus, only the FX2 input signal is inputted to the second effector 32*b*, and an audio signal of sum of the FX1 input signal and the FX2 output signal controlled in level, which are added by the adders 32*d*, is inputted to the first effector 32*a*, thereby applying the effect to the inputted audio signal. That is, the first effector 32*a* is connected in series after the second effector 32*b*, and this is described on the operating panel 1 as "2=>1". Then, the transmission level of the FX2 output signal to be sent from the second effector 32*b* to the first effector 32*a* at that time can be adjusted by the rotation operating amount to the left side of the inter-FX send knob 17.

In this way, the inter-FX send knob 17 has two functions of switching connection between the two effectors and controlling level of an audio signal supplied from one effector to the other effector. Further, since the inter-FX send knob 17 is provided across the boundary between the channel strip 11-1 and the channel strip 11-2, when the inter-FX send knob 17 is newly provided, it can be provided without enlarging the disposition space on the operating panel 1. Moreover, since the volumes 32*c* and the volumes 32*e* are such that transmission level of one volume becomes zero or transmission levels of the both volumes are zero (when the inter-FX send knob 17 is at the center position) according to the operating position of the inter-FX send knob 17, the cross-connection of the first effector 32*a* and the second effector 32*b* does not result in a loop circuit, preventing oscillations and the like.

Next, the audio signal mixed in the ST bus 20*a* is outputted from the stereo output terminal via the ST output channel 23, and the ST output channel 23 is provided with an ST output channel switch 23*a* and a fader (F) 23*b*. By operating an ON SW 18*c* of the channel strip 12, the ST output channel switch 23*a* can be turned on/off. Operating the ON SW 18*c* so as to turn on the ST output channel switch 23*a* allows outputting the audio signal from the ST bus 20*a* via the ST output channel 23, and operating the ON SW 18*c* so as to turn off the ST output channel switch 23*a* prevents sending the audio signal from the ST bus 20*a* via the ST output channel 23. Then, when the ST output channel switch 23*a* is on, by operating a fader 18*d* of the channel strip 12, the fader (F) 23*b* can be adjusted, enabling to adjust level of the audio signal from the ST bus 20*a* to be outputted from the stereo output terminal.

Further, the audio signal mixed on the AUX bus 20*b* is outputted from the output terminal via the AUX output channel 24, and the AUX output channel 24 is provided with a fader (F) 24*a*. By operating the AUX output channel knob 18*b* of the operating panel 1, the fader (F) 24*a* can be adjusted, enabling to adjust level of the audio signal from the AUX bus 20*b* to be outputted from the AUX output terminal.

Figure 5:
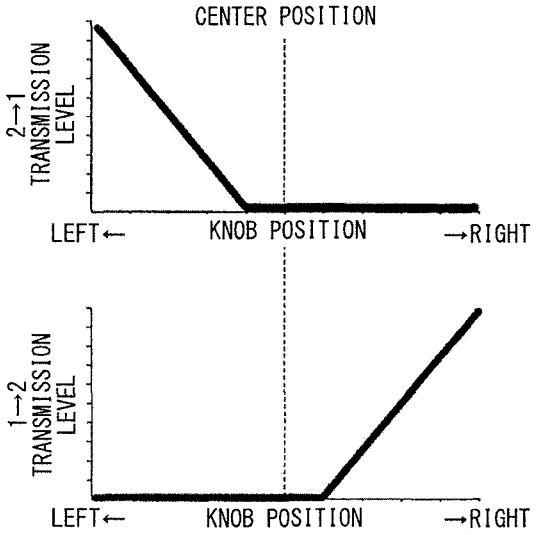
FIG. 5 is a diagram illustrating another example of transmission levels according to a knob position.

FIG. 5 illustrates a diagram illustrating another example of transmission levels of the two volumes 32*c* and the two volumes 32*e* relative to a rotation operating amount of the inter-FX send knob 17. On the transmission level illustrated in FIG. 5, in a predetermined range in which the knob position of the inter-FX send knob 17 is centered at a center position, which is a predetermined position corresponding to a center position, transmission levels of the two volumes 32*c* and the two volumes 32*e* are zero (level of $-\infty$), and the first effector 32*a* and the second effector 32*b* operate independently in parallel with each other. Then, when the inter-FX send knob 17 is rotated beyond the predetermined range on the right side, transmission level of the two volumes 32*e* becomes a transmission level corresponding to the rotation operating amount, but transmission level of the two volumes 32*c* stays at zero. Thus, only the FX1 input signal is inputted to the first effector 32*a*, and an audio signal of sum of the FX2 input signal and the FX1 output signal controlled in level by the volumes 32*e*, which are added by the adders 32*f*, is inputted to the second effector 32*b*. The second effector 32*b* is thus connected in series after the first effector 32*a*. Transmission level of the FX1 output signal to be sent from the first effector 32*a* to the second effector 32*b* can be adjusted by a rotation operating amount toward the right side beyond the predetermined range of the inter-FX send knob 17.

Further, when the inter-FX send knob 17 is rotated beyond the predetermined range on the left side, transmission level of the two volumes 32*c* becomes a transmission level corresponding to the rotation operating amount, but the transmission level of the two volumes 32*e* stays at zero. Thus, only the FX2 input signal is inputted to the second effector 32*b*, and an audio signal of sum of the FX1 input signal and the FX2 output signal controlled in level by the volumes 32*c*, which are added by the adders 32*d*, is inputted to the first effector 32*a*. The first effector 32*a* is thus connected in series after the second effector 32*b*. Transmission level of the FX2 output signal to be sent from the second effector 32*b* to the first effector 32*a* can be adjusted by a rotation operating amount toward the left side beyond the predetermined range of the inter-FX send knob 17.

Also regarding the transmission level of this example, the inter-FX send knob 17 has two functions of switching connection between the two effectors and controlling level of an audio signal supplied from one effector to the other effector. Further, since the volumes 32*c* and the volumes 32*e* are such that transmission level of one volume becomes zero or transmission levels of the both volumes are zero (when the inter-FX send knob 17 is in the central predetermined range position) according to operating position of the inter-FX send knob 17, the cross-connection of the first effector 32*a* and the second effector 32*b* does not result in a loop circuit, preventing oscillations and the like.

Figure 6:
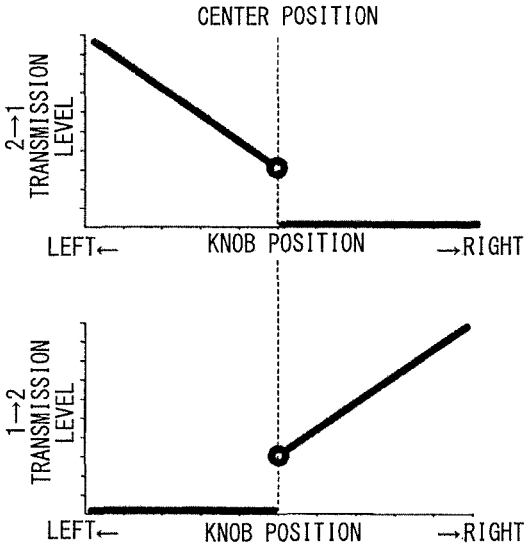
FIG. 6 is a diagram illustrating still another example of transmission levels according to a knob position.

FIG. 6 illustrates a diagram illustrating still another example of transmission levels of the two volumes 32*c* and the two volumes 32*e* relative to a rotation operating amount of the inter-FX send knob 17. On the transmission level illustrated in FIG. 6, when the inter-FX send knob 17 is at a center position, which is a predetermined position corresponding to a center position, transmission levels of the two volumes 32*c* and the two volumes 32*e* are zero (level of $-\infty$), and the first effector 32*a* and the second effector 32*b* operate independently in parallel with each other. Then, when the inter-FX send knob 17 is rotated toward the right side from the center position, transmission level of the two volumes 32*e* becomes a transmission level corresponding to the rotation operating amount, but transmission level of the two volumes 32*c* stays at zero. Thus, only the FX1 input signal is inputted to the first effector 32*a*, and an audio signal of sum of the FX2 input signal and the FX1 output signal controlled in level by the volumes 32*e*, which are added by the adders 32*f*, is inputted to the second effector 32*b*. The second effector 32*b* is thus connected in series after the first effector 32*a*. Transmission level of the FX1 output signal to be sent from the first effector 32*a* to the second effector 32*b* can be adjusted by a rotation operating amount toward the right side from the center position of the inter-FX send knob 17, but the initial value thereof is not zero and is a jumped predetermined transmission level.

Further, when the inter-FX send knob 17 is rotated toward the left side from the center position, transmission level of the two volumes 32*c* becomes a transmission level corresponding to the rotation operating amount, but transmission level of the two volumes 32*e* stays at zero. Thus, only the FX2 input signal is inputted to the second effector 32*b*, and an audio signal of sum of the FX1 input signal and the FX2 output signal controlled in level by the volumes 32*c*, which are added by the adders 32*d*, is inputted to the first effector 32*a*. The first effector 32*a* is thus connected in series after the second effector 32*b*. Transmission level of the FX2 output signal to be sent from the second effector 32*b* to the first effector 32*a* can be adjusted by a rotation operating amount toward the left side from the center position of the inter-FX send knob 17, but the initial value thereof is not zero and is a jumped predetermined transmission level.

Also regarding the transmission level of this example, the inter-FX send knob 17 has two functions of switching connection between the two effectors and controlling level of an audio signal supplied from one effector to the other effector. Further, since the volumes 32*c* and the volumes 32*e* are such that transmission level of one volume becomes zero or transmission levels of the both volumes are zero (when the inter-FX send knob 17 is at the center position) according to the operating position of the inter-FX send knob 17, the cross-connection of the first effector 32*a* and the second effector 32*b* does not result in a loop circuit, preventing oscillations and the like.

In the above description, although the Sys effect processing module 32 applies an effect to a stereo audio signal, the effect may be applied to a monaural audio signal. Accordingly, a detailed structure of a Sys effect processing module 42 which applies an effect to a monaural audio signal is illustrated in FIG. 7. This Sys effect processing module 42 may be used in place of the Sys effect processing module 32.

As illustrated in FIG. 7, the Sys effect processing module 42 has a first effector 42*a* and a second effector 42*b*. The digital FX1 input signal outputted from the ADC 31 is inputted to the first effector 42*a* as a monaural FX1' input signal via an adder 42*d*. Further, the digital FX2 input signal outputted from the ADC 31 is inputted to the second effector 42*b* as a monaural FX2' input signal via an adder 42*f*. A monaural FX1' output signal to which an effect is applied by the first effector 42*a* is sent to the DAC 33, and is also sent to an adder 42*f* via a volume 42*e*. The adder 42*f* adds the monaural FX2' input signal and the monaural FX1' output signal controlled in level by the volume 42*e*, and the result is inputted to the second effector 42*b*. Further, a monaural FX2' output signal to which an effect is applied by the second effector 42*b* is sent to the DAC 33, and is also sent to the adder 42*d* via a volume 42*c*. The adder 42*d* adds the monaural FX1' input signal and the monaural FX2' output signal controlled in level by the volume 42*c*, and the result is inputted to the first effector 42*a*. The volume 42*c* and the volume 42*e* can be adjusted as described above by rotating the inter-FX send knob 17 provided across the boundary between the channel strip 11-1 and the channel strip 11-2.

Switching of connection between two effectors, the first effector 42*a* and the second effector 42*b*, and controlling level of an audio signal supplied from one effector to the other effector by rotating the inter-FX send knob 17 are similar to the operation in the Sys effect processing module 32 illustrated in FIG. 4 to FIG. 6, and thus detailed descriptions thereof are omitted.

Further, the monaural FX1' signal and the monaural FX'2 signal are supplied from the DAC 33 to the first and second EF input channels, respectively, and thus it is only necessary to prepare one for monaural as each of the switch 22*a* and the fader 22*b* of each EF input channel, and a monaural signal is supplied from the fader 22*b* to the ST bus 20*a*. Further, an output of the switch 22*a* is a monaural signal, and thus it is not necessary to provide the adder 22*d* which turns a stereo signal into a monaural signal.

INDUSTRIAL APPLICABILITY

The effect applying apparatus of the invention as described above is an effector incorporated in an analog mixer but is not limited thereto, and may be applied to an effector incorporated in other audio apparatuses, such as digital mixers, digital recorders, powered speakers, electronic instruments, and the like for example. Further, it may also be applied to a single effector which is not incorporated in another apparatus.

Further, the embodiment of the effect applying apparatus of the present invention is a digital effector but is not limited thereto, and may be an analog effector. Moreover, in the embodiment, although a first wiring from the output of the first effector to the input of the second effector and a second wiring from the output of the second effector to the input of the first effector exist at the same time, these two wirings only operate exclusively. Accordingly, in the case of a digital effector, it may be controlled so that only a wiring in either one direction according to an operating direction of the knob exists. Specifically, it may be controlled such that when the knob is located on the right side of the center position, the first wiring is performed, and when it is located on the left side of the center position, the second wiring is performed. In this case, when the knob is on the right side of the center position, any input other than the output of the first effector may be cut automatically in the second effector, and when the knob is on the left side of the center position, any input other than the output of the second effector may be cut automatically in the first effector.

Furthermore, the structure of the input channels, buses and output channels is not limited to that of the above described embodiment. For example, although there are only monaural input channels in the above embodiment, a structure which is further provided with stereo input channels may be employed. For example, although there are one ST bus and one ST output channel in the above embodiment, a structure having a plurality of each of them may be employed. Further, although there are one AUX bus and one AUX output channel in the above embodiment, a structure having a plurality of each of them may be employed.

Note that the "predetermined position corresponding to a center position" need not necessary be the midpoint of operable range, and may be a predetermined position displaced to ether one side of the midpoint.

Furthermore, the first effector and the second effector may be realized by an effect applying program activated on a computer. In this case, the effect applying program activated on a computer includes first effector processing and second effector processing, and control similar to the case of the inter-FX send knob 17 according to the above described embodiment of the invention is performed according to the user's operation of one knob displayed on a screen.

Although the above described embodiment of the effect applying apparatus of the invention is an effect applying apparatus incorporated in a mixer, the effect applying apparatus of the invention may be a stand-alone effect applying apparatus having an inter-FX send knob 17 and a circuit block 30.

Further, although the embodiment (FIG. 3, FIG. 7) of the effect applying apparatus of the invention is an apparatus which processes a digital audio signal, it may be an apparatus processing an analogue audio signal.

Moreover, although the inter-FX send knob 17 according to the embodiment of the effect applying apparatus of the invention is a rotating knob which is rotated leftward and rightward and is limited in a rotating range, the inter-FX send knob 17 may be a rotary encoder having no such limit, a slider operated by sliding, a lever operated by moving the lever, or the like.

In the above described embodiment of the effect applying apparatus of the invention, the first effector is constantly supplied with the FX1 input signal and the second effector is constantly supplied with the FX2 input signal, but this is not an essential condition. With the adders (32*d* and 32*f* of FIG. 3, and 42*d* and 42*f* of FIG. 7) on the input side of each effector illustrated in FIG. 3 and FIG. 7 being replaced with selectors, the apparatus may be structured such that when a transmission level from one effector to the other effector is not zero, an FX* input signal (* is 1 or 2) is not supplied to the other effector. More specifically, control may be performed with the above selectors such that (1) when both of "1=>2" transmission level and "2=>1" transmission level are zero, the FX1 input signal is supplied to the first effector and the FX2 input signal is supplied to the second effector, (2) when "1=>2" transmission level is not zero and "2=>1" transmission level is zero, the FX1 input signal is supplied to the first effector and the FX1 output signal adjusted according to the "1=>2" transmission level is supplied to the second effector, and (3) when "1=>2" transmission level is zero and "2=>1" transmission level is not zero, the FX2 output signal adjusted according to the "2=>1" transmission level is supplied to the first effector and the FX2 input signal is supplied to the second effector.

In the above description, since an effect applying apparatus executing an effect applying method of the invention is an effect applying apparatus of the invention, the description of the effect applying method of the invention is omitted.

REFERENCE SIGNS LIST

1 . . . operating panel, 2 . . . mixer, 10-1 to 10-*n* . . . channel strips for mono input channels, 11-1 and 11-2 . . . channel strips for EF input channels, 12 . . . channel strip for ST output channel, 13*a* . . . phantom switch, 13*b* . . . gain adjusting knob, 13*c* . . . compressor adjusting knob, 13*d* . . . high-band adjusting knob, 13*e* . . . mid-band adjusting knob, 13*f* . . . low-band adjusting knob, 13*g* . . . AUX send knob, 13*h* . . . first FX send knob, 13*i* . . . second FX send knob, 13*j* . . . localization position adjusting knob, 13*k* . . . channel switch, 13*m* . . . channel fader, 14 . . . EF number display module, 15*a* and 15*b* . . . SysEF selecting knobs, 15*c* and 15*d* . . . SysEF data adjusting knobs, 16*a* . . . AUX send knob, 16*b* . . . ON switch, 16*c* . . . effect fader, 17 . . . inter-FX send knob, 18*a* . . . AUX return channel knob, 18*b* . . . AUX output channel knob, 18*c* . . . ON switch (ON SW), 18*d* . . . stereo fader (Fader), 20 . . .

analog circuit block, 20*a* . . . ST bus, 20*b* . . . AUX bus, 20*c*-1 and 20*c*-2 . . . FX buses, 21*a* . . . characteristic adjusting module, 21*b* and 22*a* . . . channel switches, 21*c* . . . fader, 21*d*, 21*e* and 22*c* . . . volumes, 21*f* . . . pan, 22*d* . . . adder, 23 . . . ST output channel, 23*a* . . . ST output channel switch, 23*b* and 24*a* . . . faders, 24 . . . AUX output channel, 30 . . . digital circuit block, 31 . . . ADC, 32 and 42 . . . Sys effect processing modules, 32*a* and 42*a* . . . first effectors, 32*b* and 42*b* . . . second effectors, 32*c*, 32*e* and 42*e* . . . volumes, 32*d*, 32*f*, 42*d* and 45*f* . . . adders, 33 . . . DAC

The invention claimed is:

1. An effect applying apparatus comprising:

first effector circuitry for applying a first audio effect to an audio signal supplied to the first effector circuitry;

second effector circuitry for applying a second audio effect to an audio signal supplied to the second effector circuitry;

a user-operable control for being operated, by a displacing operation by a user, for transitioning between different operating positions; and controller circuitry for:

switching, based on the user-operable control transitioning between different operating positions, between two different orders of operative connection between the first effector circuitry and the second effector circuitry, and controlling a level of an audio signal supplied from one of the first effector circuitry and the second effector circuitry disposed in a previous stage to the other of the first effector circuitry and the second effector circuitry disposed in a subsequent stage, according to an amount of displacement of an operating position of the user-operable control from a predetermined position of the user-operable control.

2. An effect applying apparatus comprising:

first effector circuitry for applying a first audio effect to an audio signal InF1 supplied to the first effector circuitry;

second effector circuitry for applying a second audio effect to an audio signal InF2 supplied to the second effector circuitry;

a knob to be operated by user operation; and controller circuitry for controlling supply of the audio signals InF1 and InF2 to the first effector circuitry and the second effector circuitry, wherein, when the knob is displaced toward a first direction from a predetermined position corresponding to a center, said controlling by the controller circuitry comprises:

controlling a level of an audio signal OutF1 outputted from the first effector circuitry according to an amount of the displacement of the knob and supplying the audio signal OutF1 after its level id controlled, as the audio signal InF2, to the second effector circuitry to make the second effector circuitry output an audio signal OutF1F2 to which the first audio effect is applied and then the second audio effect is applied, and wherein, when the knob is displaced toward a second direction from the predetermined position, said controlling by the controller circuitry comprises:

controlling a level of an audio signal OutF2 outputted from the second effector circuitry according to amount of the displacement of the knob and supplying the audio signal OutF2 after its level is controlled, as the audio signal InF1, to the first effector circuitry to make the first effector circuitry output an audio signal OutF2F1 to which the second audio effect is applied and then the first audio effect is applied.

3. The effect applying apparatus according to claim 2, comprising:

wherein, when the knob is displaced toward said first direction from the predetermined position, said controlling by the controller circuitry comprises:

supplying a sum of the audio signal OutF1 after its level is controlled and an audio signal InAdd2, as the audio signal InF2, to the second effector circuitry, and wherein, when the knob is displaced toward said second direction from the predetermined position, said controlling by the controller circuitry comprises:

supplying a sum of the audio signal OutF2 after its level is controlled and an audio signal InAdd1, as the audio signal InF1, to the first effector circuitry.

4. The effect applying apparatus according to claim 2, wherein, when the knob is placed at the predetermined position corresponding to the center, said controlling by the controller circuitry comprises:

supplying the audio signal InF1 to the first effector circuitry to make the first effector circuitry output an audio signal OutF1notF2 to which the first audio effect is applied, the audio signal OutF1notF2 not supplied to the second effector circuitry, and supplying the audio signal InF2 to the second effector circuitry to make the second effector circuitry output an audio signal OutF2notF1 to which the second audio effect is applied, the audio signal OutF2notF1 not supplied to the first effector circuitry.

5. A method for applying audio effect comprising:

applying a first audio effect with first effector circuitry to an audio signal InF1 supplied to the first effector circuitry;

applying a second audio effect with second effector circuitry to an audio signal InF2 supplied to the second effector circuitry; and controlling supply of the audio signals InF1 and InF2 to the first effector circuitry and the second effector circuitry according to position of a knob which is to be operated by user operation, wherein, when the knob is displaced toward a first direction from a predetermined position corresponding to a center, said controlling comprises:

controlling a level of an audio signal OutF1 outputted from the first effector circuitry according to amount of the displacement of the knob and supplying the audio signal OutF1 after its level is controlled, as the audio signal InF2, to the second effector circuitry to make the second effector circuitry output an audio signal OutF1F2 to which the first audio effect is applied and then the second audio effect is applied, and wherein, when the knob is displaced toward a second direction from the predetermined position, said controlling comprises:

controlling a level of an audio signal OutF2 outputted from the second effector circuitry according to amount of the displacement of the knob and supplying the audio signal OutF2 after its level is controlled, as the audio signal InF1, to the first effector circuitry to make the first effector circuitry output an audio signal OutF2F1 to which the second audio effect is applied and then the first audio effect is applied.

6. The method for applying audio effect according to claim 5, wherein, when the knob is displaced toward said first direction from the predetermined position, said controlling comprises:

supplying a sum of the audio signal OutF1 after its level is controlled and an audio signal InAdd2, as the audio signal InF2, to the second effector circuitry, and wherein, when the knob is displaced toward said second direction from the predetermined position, said controlling comprises:

supplying a sum of the audio signal OutF2 after its level is controlled and an audio signal, as the audio signal InAdd1, InF1, to the first effector circuitry.

7. The method for applying audio effect according to claim 5, wherein, when the knob is placed at the predetermined position corresponding to the center, said controlling comprises:

supplying the audio signal InF1 to the first effector circuitry to make the first effector circuitry output an audio signal OutF1notF2 to which the first audio effect is applied, the audio signal OutF1notF2 not supplied to the second effector circuitry and supplying the audio signal InF2 to the second effector circuitry to make the second effector circuitry output an audio signal OutF2notF1 to which the second audio effect is applied, the audio signal OutF2notF1 not supplied to the first effector circuitry.

8. The effect applying apparatus according to claim 1, wherein the user-operable control is a knob.

9. The effect applying apparatus according to claim 8, wherein the user-operable control is a rotating knob, and the displacement is a rotation of the rotating knob from the predetermined position.

10. The effect applying apparatus according to claim 1, wherein the displacement is signaled to the controller circuitry by an analog position signal.

11. An effect applying apparatus comprising:

a computer including a display, the computer, via an effect applying program activated on the computer, configured for performing:

first effector processing for applying a first audio effect to an audio signal supplied to the first effector processing;

second effector processing for applying a second audio effect to an audio signal supplied to the second effector processing;

displaying on the display a user-operable control for being operated, by a displacing operation by a user, for transitioning between different operating positions;

switching, based on the user-operable control transitioning between different operating positions, between two different orders of operative connection between the first effector processing and the second effector processing; and controlling a level of an audio signal supplied from one of the first effector processing and the second effector processing disposed in a previous stage to the other of the first effector processing and the second effector processing disposed in a subsequent stage, according to an amount of displacement of an operating position of the user-operable control from a predetermined position of the user-operable control.

12. The effect applying apparatus according to claim 11, wherein the user-operable control is a knob displayed on the display.

13. The effect applying apparatus according to claim 12, wherein the user-operable control is a rotating knob, and the displacement is a rotation of the rotating knob from the predetermined position.

* * * * *